US011253065B2

(12) United States Patent
Maynes

(10) Patent No.: US 11,253,065 B2
(45) Date of Patent: Feb. 22, 2022

(54) PADDED BENCH ASSEMBLY WITH HEIGHT ADJUSTABLE EASEL AND RIDGED SURFACE FOR IMPROVED CANVAS SUPPORT

(71) Applicant: Studio Designs Inc., Commerce, CA (US)

(72) Inventor: Scott Maynes, Commerce, CA (US)

(73) Assignee: Studio Designs Inc., Commerce, CA (US)

( * ) Notice: Subject to any disclaimer, the term of this patent is extended or adjusted under 35 U.S.C. 154(b) by 0 days.

(21) Appl. No.: 16/245,884

(22) Filed: Jan. 11, 2019

(65) Prior Publication Data

US 2019/0208905 A1 Jul. 11, 2019

Related U.S. Application Data

(60) Provisional application No. 62/616,225, filed on Jan. 11, 2018.

(51) Int. Cl.
*A47B 83/00* (2006.01)
*A47C 11/00* (2006.01)
*A47C 15/00* (2006.01)

(52) U.S. Cl.
CPC ..... *A47B 83/008* (2013.01); *A47C 11/00* (2013.01); *A47C 15/004* (2013.01)

(58) Field of Classification Search
CPC ..... A47B 83/008; A47B 85/02
USPC ..... 297/135
See application file for complete search history.

(56) References Cited

U.S. PATENT DOCUMENTS 2,918,107 A * 12/1959 Cote ..... A47B 41/04 297/156
3,399,925 A * 9/1968 Levy ..... A47B 83/008 297/156
3,907,360 A * 9/1975 Czarnowski ..... A47B 83/00 297/156
3,998,421 A * 12/1976 Clemison ..... A47B 97/04 248/447.1
4,921,302 A * 5/1990 Godwin ..... A47B 83/02 297/170

(Continued)

FOREIGN PATENT DOCUMENTS

CA 2217981 A1 * 4/1999 ..... A47B 83/008
FR 1018946 A * 1/1953 ..... A47B 83/008

(Continued)

*Primary Examiner* — David E Allred
(74) *Attorney, Agent, or Firm* — Elizabeth Yang

(57) ABSTRACT

A padded bench assembly with height adjustable easel and ridged surface provides an elongated frame. The frame supports a canvas at a desired height and slope. The frame also supports an artist, and includes a cushioned seat for the artist to sit on while working on the canvas. The artist bench provides an elongated frame at least 29" long for an artist to sit. The frame has a cushioned seat for artist comfort while sitting and working on canvas. The bench assembly allows for selective positioning of the canvas, at adjustable angles, through height adjustment of a canvas support bar, and selective setting of the edge of the canvas in one of multiple ridges in a ridged canvas support panel. The artist sit at a desired distance from the canvas, and position the canvas at an angle for working on the canvas, while minimizing slippage by the canvas.

20 Claims, 8 Drawing Sheets

(56) References Cited

U.S. PATENT DOCUMENTS

| | | | | | |
|---|---|---|---|---|---|
| 5,606,917 | A * | 3/1997 | Cauffiel | A47B 23/02 | 108/42 |
| 6,302,032 | B1 * | 10/2001 | Ranspach | A47B 97/04 | 108/12 |
| 6,663,074 | B2 * | 12/2003 | Prior | A47B 85/00 | 108/167 |
| 6,953,222 | B2 * | 10/2005 | Larrick | A47C 9/08 | 297/118 |
| 2014/0001795 | A1 * | 1/2014 | Hayles | A47B 83/008 | 297/135 |
| 2016/0008689 | A1 * | 1/2016 | Janeri | A47C 15/004 | 273/402 |
| 2016/0198859 | A1 * | 7/2016 | Labbett | A47C 16/04 | 297/183.1 |
| 2017/0251803 | A1 * | 9/2017 | Rehkemper | A47B 39/06 | |

FOREIGN PATENT DOCUMENTS

| | | | | | |
|---|---|---|---|---|---|
| GB | 191216086 | A | * | 2/1913 | A47B 85/02 |
| GB | 509946 | A | * | 7/1939 | A47B 85/02 |
| GB | 1016754 | A | * | 1/1966 | A47B 83/008 |
| GB | 2018582 | A | * | 10/1979 | A47B 27/02 |

* cited by examiner

| | | | |
|---|---|---|---|
| Front Leg<br>Pata delantera<br>Pied avant | 1 | 108a,<br>108b |  |
| Rear Leg<br>Pata trasera<br>Pied arriere | 1 | 108c,<br>108d |  |
| T Support Bar<br>Barra de soporte en T<br>Pied en T | 1 | 122 |  |
| Cushion<br>Cojin<br>Coussion | 1 | 114 |  |
| Wood Board<br>Tabla de madera<br>Panneaux de bois | 1 | 116 |  |
| Lower Bar<br>Barra inferior<br>Barre inferieure | 1 | 104 |  |
| Upper Bar<br>Barra superior<br>Barre superieure | 2 | 106a |  |

| | | | |
|---|---|---|---|
| Clamp<br>Broche<br>Etau | 1 | 124 |  |
| Washer<br>Arandela<br>Rondelle | 6 | 128a |  |
| Allen Bolt - 1/4" x 13/4"<br>Bulon Allen - 6.4mm x 44.5mm<br>Vis Allen - 6.4mm x 44.5mm | 6 | 128b |  |
| Allen Bolt - 1/4" x 13/8"<br>Bulon Allen - 6.4mm x 34.8mm<br>Vis Allen - 6.4mm x 34.8mm | 6 | 128c |  |
| Allen Wrench<br>Llave Allen<br>Cle Allen | 1 | 204 |  |

PADDED BENCH ASSEMBLY WITH HEIGHT ADJUSTABLE EASEL AND RIDGED SURFACE FOR IMPROVED CANVAS SUPPORT

CROSS REFERENCE OF RELATED APPLICATIONS

This application claims the benefits of U.S. provisional application No. 62/616,225, filed Jan. 11, 2018, and entitled ELONGATED ARTIST BENCH WITH RIDGED CANVAS SUPPORT, which provisional application is incorporated by reference herein in its entirety.

FIELD OF THE INVENTION

The present invention relates generally to a padded bench assembly with height adjustable easel and ridged surface for improved canvas support. More so, an artist bench used by an artist provides a cushioned, elongated upper support for an artist to sit on, and a ridged canvas support panel with a height adjustable easel to support a canvas, or general drawing board, at a desired slope.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a bench is a long seat upon which manual art work is performed. The artist bench often comprises an easel for supporting a canvas or drawing board. The easel may include an upright support used for displaying and/or fixing the canvas, or other art related item, at an angle of about 20° to the vertical. In particular, easels are traditionally used by painters to support a painting while they work on it, normally standing up, and are also sometimes used to display finished paintings.

It is known in the art that artists often draw or paint remotely from their studios, and accordingly must transport their canvas or boards, and paints or drawing materials to such a remote location. Once the artist arrives, they are in need of a seat upon which to sit and an easel or other support for their canvas, or drawing board. Further, the canvas must be supported at a fixed angle and the artist must be at a comfortable distance from the canvas so that accessing and working on the canvas is performed at an optimal level.

Other proposals have involved supporting artist canvases from a bench. The problem with these support structures is that they do not prevent the canvas from slipping while being held upright. Also, the slope of the canvas is not adjustable. Even though the above cited gripping devices meets some of the needs of the market, a hose gripping apparatus that wraps around a pressurized hose and provides a handle, so as to enhance the grip on a pressurized hose by magnifying a grip pressure on the hose during operation, facilitating manipulation of the hose, and adjusting for various hose sizes and pressures is still desired.

SUMMARY

Illustrative embodiments of the disclosure are generally directed to a padded bench assembly with height adjustable easel and ridged surface for improved canvas support. The padded bench assembly is a unique artist bench that serves not only to comfortably support the artist while working with, or displaying the canvas; but also allows for selective sloped-positioning of the canvas directly from the bench assembly.

In one possible embodiment, the bench assembly may be used by an artist to rest on while working on, or displaying a canvas. The padded bench assembly may include an elongated artist bench having a cushioned, elongated upper support for an artist to sit on at a first end of the bench, and a ridged section with a height adjustable easel at a second end of the bench to support a canvas, or general drawing board, at a fixed angle for working on, or displaying the canvas. The orientation of the canvas may be set to a desired slope based on its position in the ridges, and the height of the canvas support bar.

In some embodiments, the padded bench assembly comprises an elongated frame comprising at least one lower longitudinal support bar, at least one upper longitudinal support bar, four legs, and at least four traversed support bars extending between the legs. The frame is defined by a proximal end and a distal end. The frame also has a length of at least 29".

In some embodiments, the bench assembly provides a cushioned seat that positions longitudinally across the proximal end of the frame. Further, a canvas support panel positions longitudinally across the distal end of the frame. The canvas support panel is defined by a plurality of spaced-apart ridges that are sized and dimensioned to receive an edge of a canvas.

In some embodiments, a sleeve fixedly attaches to the support bar at the distal end of the frame. A canvas support bar is insertable in the sleeve. The canvas support bar is slidably moveable in the sleeve. The bench assembly may also include a clamp for fastening the support bar. The clamp comprises a body, a friction mechanism, and at least one fastening hole.

In some embodiments, the body of the clamp surrounds the canvas support bar and the sleeve. The friction mechanism is rotatable in a first direction to at least partially tighten the body of the clamp about the canvas support bar and the sleeve. The friction mechanism is rotatable in a second direction to at least partially loosen the body of the clamp from the canvas support bar and the sleeve.

In some embodiments, at least one fastener passes through the fastening hole in the clamp. The fastener is rotatable in the first direction to at least partially tighten the body of the clamp about the canvas support bar and the sleeve. The fastener is rotatable in the second direction to at least partially loosen the body of the clamp from the canvas support bar and the sleeve. In this manner, the canvas support bar is height adjustable relative to the sleeve through manipulation of the friction mechanism and the fastener.

In another aspect, the support cushion is a foam, poly foam, or lux foam, or other cushioning materials as known in the art.

In another aspect, the canvas support bar has a horizontal member that forms a T-bar.

In another aspect, the at least one fastener comprises a washer to create spacing between the at least one fastener and the canvas support bar.

In another aspect, the bench assembly comprises an Allen wrench to rotate the fastener.

In another aspect, the friction mechanism comprises a threaded screw.

In another aspect, the at least one fastener comprises a ¼"×1¾" Allen bolt, and a ¼"×1⅜" Allen bolt.

In another aspect, the canvas comprises a drawing or painting board.

One objective of the present invention is to provide a padded bench that is elongated to provide extra length and space for an artist to work on a canvas, and also support a canvas at a desired slope relative to the artist.

Another objective is to provide a cushioned seat for an artist to sit on while working on a canvas.

Another objective is to provide canvas support bar, or easel, that positions directly in front of the artist and is height adjustable for adjusting the angle of the canvas to the vertical.

Another objective is to provide fastening means to retain the canvas support bar at a fixed height.

Another objective is to provide ridges that allow the edge of the canvas to rest, such that the position of the canvas in the ridge and the height of the canvas support bar enable selective positioning of the canvas at a fixed angle relative to the artist.

Another objective is to provide comfortable padding on the frame of the bench assembly.

Another objective is to provide an inexpensive to manufacture padded bench assembly for supporting an artist and canvas.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 8A shows the canvas support bar in an extended position, and FIG. 8B shows the canvas support bar in a retracted position, in accordance with an embodiment of the present invention.

Like reference numerals refer to like parts throughout the various views of the drawings.

DETAILED DESCRIPTION OF THE INVENTION

Figure 1:
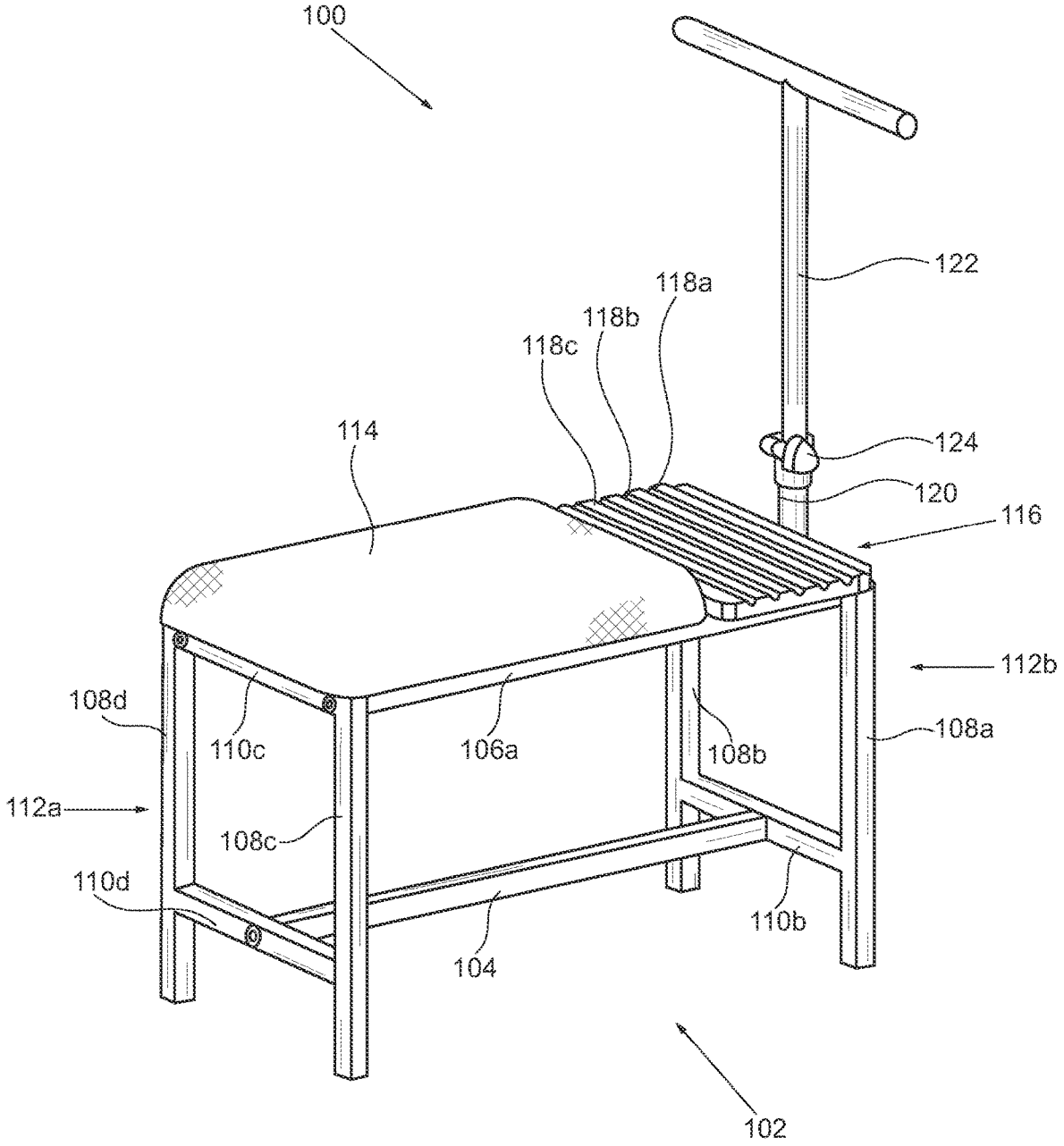
FIG. 1 illustrates a perspective view of an exemplary padded bench assembly with height adjustable easel and ridged surface retaining a canvas at an angle to vertical, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-8B, a padded bench assembly with height adjustable easel and ridged surface for improved canvas support. The padded bench assembly 100, hereafter "assembly 100" provides an elongated frame 102 and a cushioned seat 114 that serves as a sitting surface for an artist 206. The frame 102 also provides a support for a canvas 200, or general artist drawing board, to be positioned at a desired angle to vertical; and an elongated cushioned seat 114 for an artist 206 to sit on, or for setting art related items on, while the artist 206 works on the canvas 200.

The present invention also enables the canvas 200 to be selectively positioned at adjustable angles through manipulation of the canvas 200 on a height adjustable canvas support bar 122 and a ridged canvas support panel 116. The height of the canvas support bar 122 is also determinate of the slope of the canvas 200. In this manner, the artist 206 has enhanced access to the canvas 200 and the canvas can be displayed at a more favorable position.

FIG. 1 illustrates a perspective view of an exemplary padded bench assembly 100 with height adjustable easel and ridged surface provides an elongated frame. The padded bench assembly 100 includes a ridged canvas support panel 116 and a height adjustable canvas support bar 122 that can be easily adjusted to retain a canvas 200 at a desired slope to vertical.

In some embodiments, the padded bench assembly 100 provides a frame 102 that supports a canvas 200 at a desired height and slope. The frame 102 also supports an artist 206, and includes a cushioned seat 114 for the artist 206 to sit on while working on the canvas 200. The artist padded bench assembly 100 assembly allows for selective positioning of the canvas 200, at adjustable angles, through height adjustment of a canvas support bar, and selective setting of the edge of the canvas in one of multiple ridges in a ridged canvas support panel. The artist sit at a comfortable distance from the canvas, and position the canvas at an angle for working on the canvas, while minimizing slippage by the canvas 200.

The padded bench assembly 100 may provide a supportive frame 102 comprising an arrangement of support bars 104, 106*a-b* and legs 108*a-d* set in perpendicular for optimal structural support while the artist works. The padded bench assembly 100 may also include a cushioned seat 114 at a proximal end 112*a* of the frame 102 for an artist 206 to sit comfortably.

Figure 2:
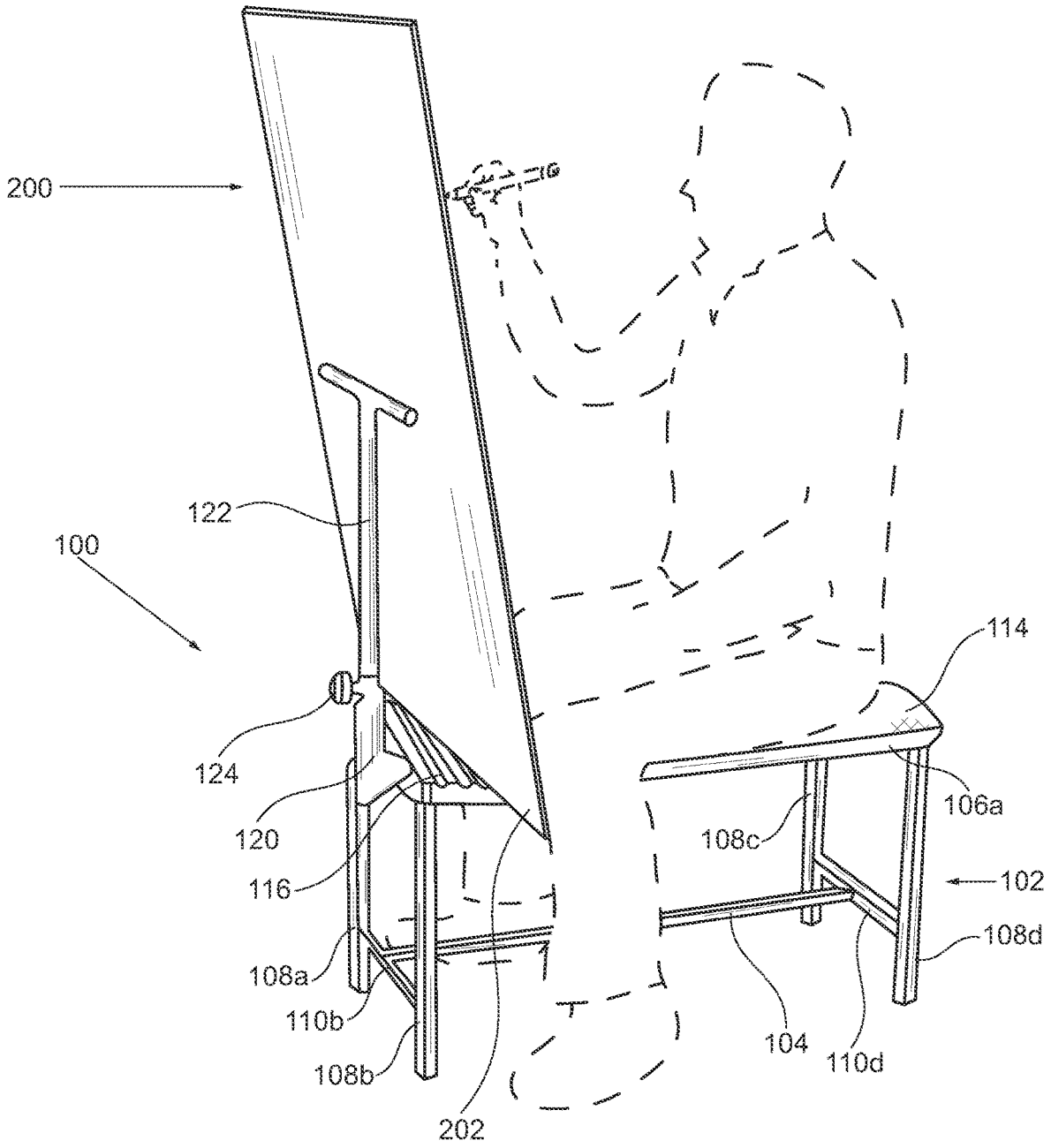
FIG. 2 illustrates a right side rear perspective view of a padded bench assembly with height adjustable easel and ridged surface for improved canvas support, showing an artist sitting on the artist bench while working on the canvas, in accordance with an embodiment of the present invention.
Figure 3:
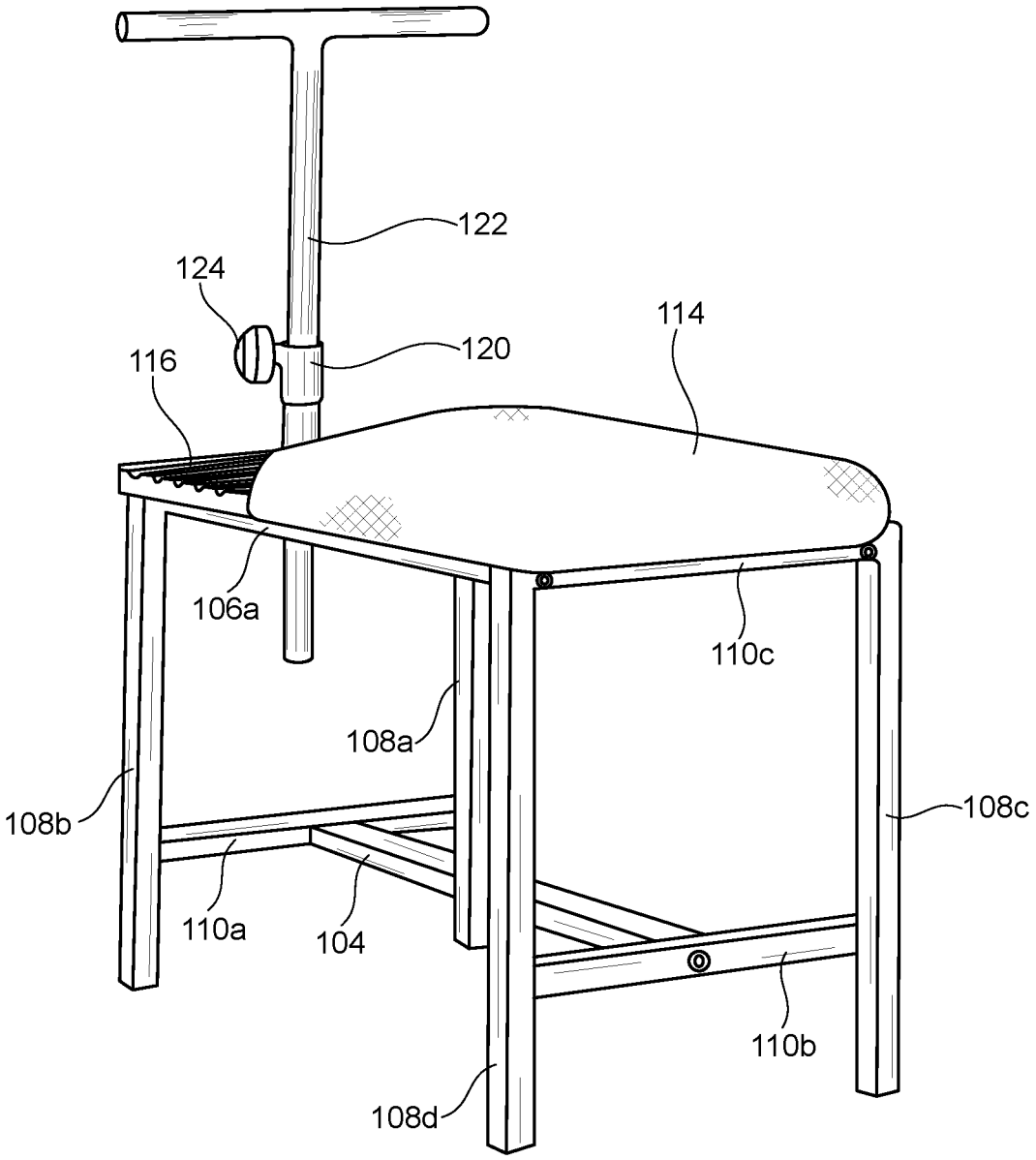
FIG. 3 illustrates a left side rear perspective view of the padded bench assembly shown in FIG. 2, in accordance with an embodiment of the present invention.

Looking now at FIG. 2, from the padded bench assembly 100, the artist 206 sits upright and at a comfortable distance from the canvas 200 while working, or displaying the canvas 200. Significantly, the bench assembly 100 also provides a ridged canvas 200 and height adjustable canvas support bar 122 at a distal end 112*b* of the frame 102 that receive the edges 202 of the canvas 200, such that the canvas 200 is positioned at a fixed angle.

In this manner, the artist can comfortable sit at a desired distance from the canvas 200, and position the canvas 200 at a desired angle for working on, or display the canvas 200, while minimizing slippage by the canvas 200. The canvas support bar 122 may include a horizontal member 130 that forms a T-bar at the terminus of the canvas support bar.

Those skilled in the art will recognize that a bench is a long seat upon which manual art work is performed. The artist bench often comprises an easel for supporting a canvas or drawing board. The easel may include an upright support used for displaying and/or fixing the canvas, or other art related item, at an angle of about 20° to the vertical. In particular, easels are traditionally used by painters to support a painting while they work on it, normally standing up, and are also sometimes used to display finished paintings.

Thus, the artist requires that the canvas be supported at a fixed angle and the artist must be at a comfortable distance from the canvas so that accessing and working on the canvas is performed at an optimal level. The present invention provides a cushioned seat 114 for an artist to sit on at proximal end 112*a* of the frame 102, and a ridged canvas 200 and height adjustable canvas support bar 122 at the distal end 112*b* of the frame 102 to support the artist's canvas 200 at a fixed angle for working, or displaying.

Figure 4:
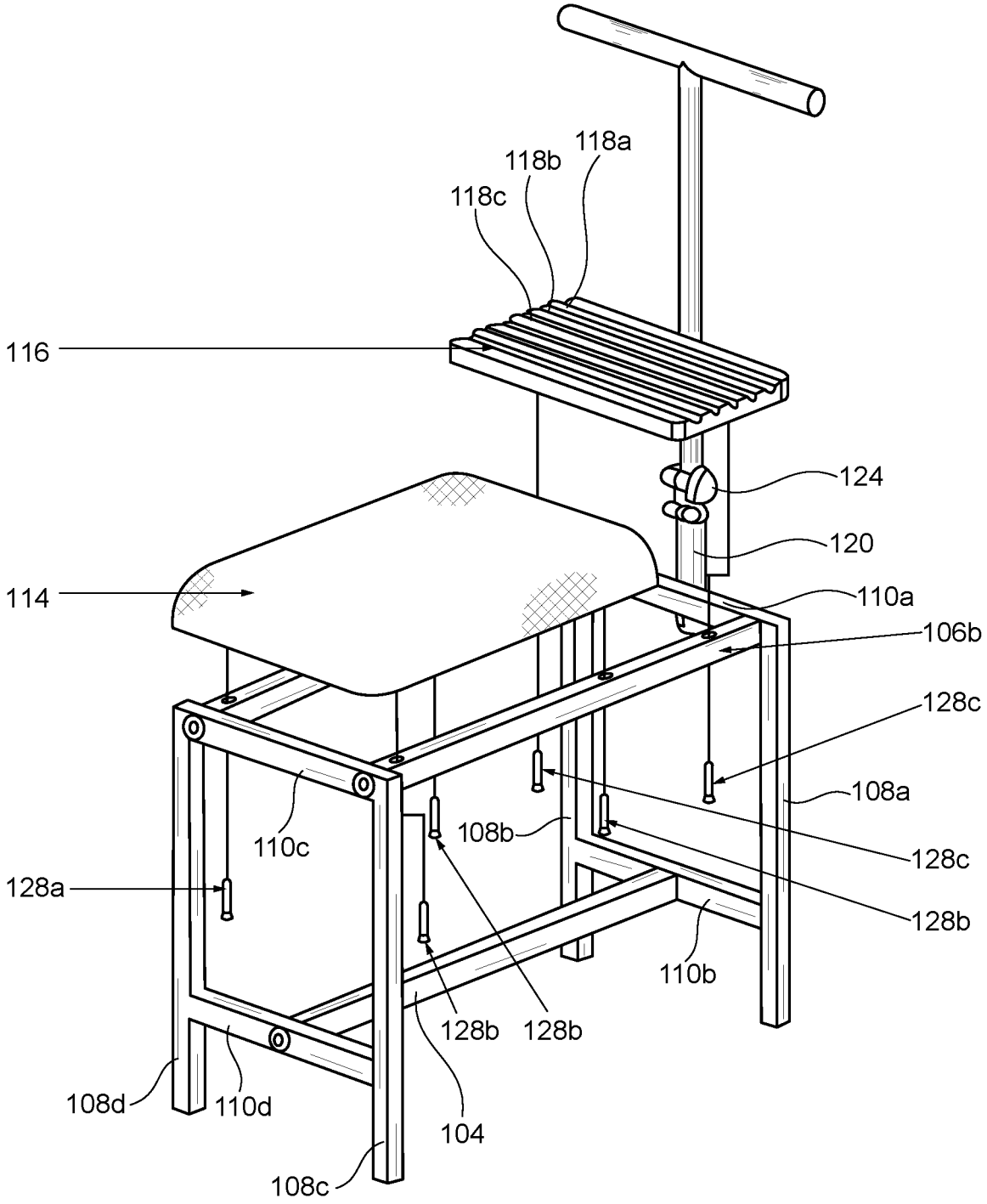
FIG. 4 illustrates a blow up view of the padded bench assembly shown in FIG. 2, in accordance with an embodiment of the present invention.

FIG. 4 references the padded bench assembly 100, showing the elongated bench-style, which is at least 29" long for the present invention. This extended length provides greater space for the artist to work with the canvas 200. For example, the extended length is also advantageous for artists with longer arms, as the artist can sit further away from the canvas 200. Also, the surface area in front of the artist is greater, which provides an area to set art related items, such as paint, pictures, and drawing instruments. In one possible embodiment, the frame 102 is defined by a length of at least 29". Though a greater length may be used in other embodiments.

In some embodiments, the padded bench assembly 100 may include an elongated frame 102. The frame 102 is defined by a proximal end 112*a* and a distal end 112*b*. The artist positions on the proximal end 112*a*, facing the canvas 200 that is positioned at the distal end 112*b* of the frame 102. In another embodiment, the frame 102 comprises at least one lower longitudinal support bar 104, at least one upper longitudinal support bar 106*a*, 106*b*, four legs 108*a-d*, and at least four traversed support bars 110*a-d* extending between the legs 108*a-d*.

The longitudinal support bars 104, 106*a-b* and the traversed support bars 110*a-d* have a perpendicular relationship to each other, as shown in FIG. 2. The legs 108*a-d* may terminate at rubber feet to provide greater stability to the padded bench assembly 100. The legs may be fabricated from a rigid material, such as aluminum, steel, metal alloys, wood, and a rigid polymer.

In some embodiments, the padded bench assembly 100 may provide a cushioned seat 114 that is positioned longitudinally across the proximal end 112*a* of the frame 102. The cushioned seat 114 provides a comfortable component for the artist to sit on while working on the canvas 200. The cushioned seat 114 also provides a surface area to set art related items on while the artist is working. In some embodiments, the cushioned seat 114 comprises a support cushion that may include, without limitation, a foam, poly foam, or lux foam, or other cushioning materials as known in the art.

Figure 6:
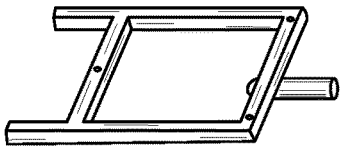
FIG. 6 illustrates perspective views of components of the padded bench assembly, including the frame, cushioned, and ridged canvas support panel, in accordance with an embodiment of the present invention.
Figure 6:
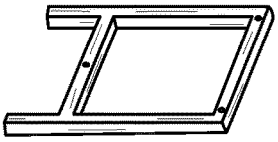
Figure 6:
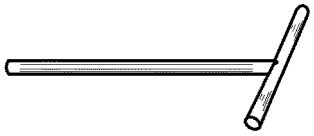
Figure 6:
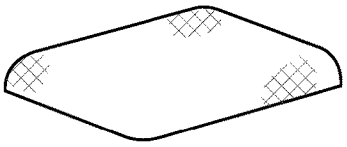
Figure 6:
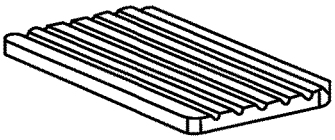
Figure 6:
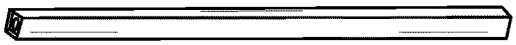
Figure 6:
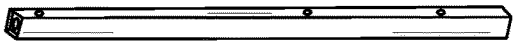

As referenced in FIG. 6, the padded bench assembly 100 further includes a canvas support panel 116. The canvas support panel 116 helps support the canvas 200. The canvas support panel 116 is disposed coplanar, and adjacent to the cushioned seat 114. The canvas support panel 116 is positioned longitudinally across the distal end 112*b* of the frame 102.

Figure 8A:
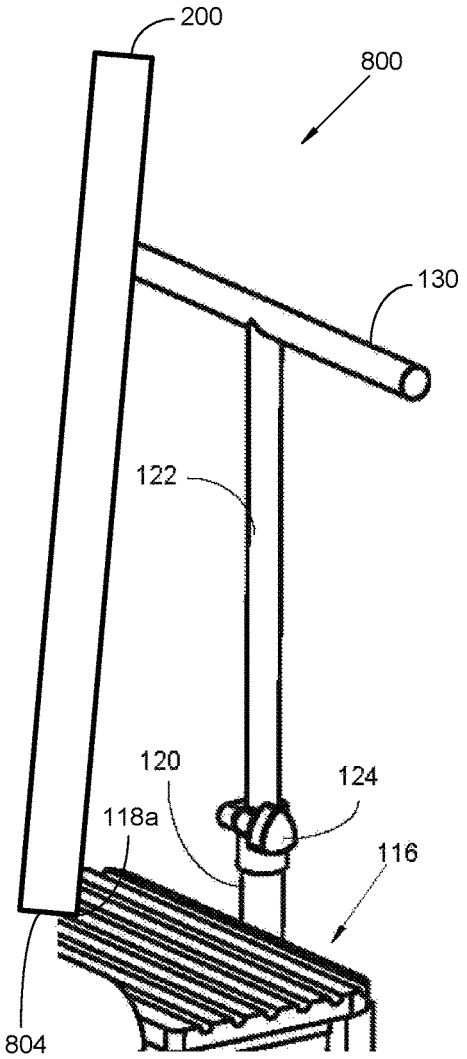
FIGS. 8A and 8B illustrate perspective views of the canvas support bar, where
Figure 8B:
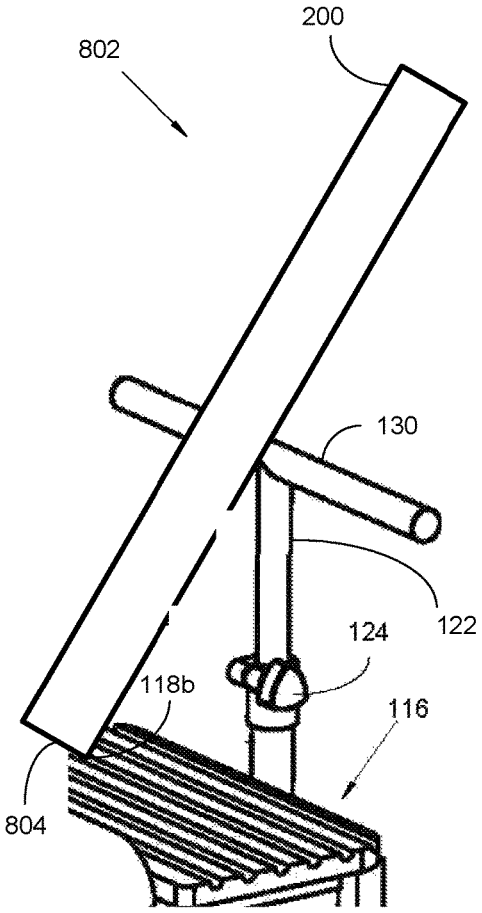

In one embodiment, the canvas support panel 116 is defined by a plurality of ridges 118*a-c*, whereby the ridges 118*a-c* receive a lower edge 804 of the canvas 200 (FIGS. 8A-8B). The slope of the canvas 200 to vertical is partially determined by which ridge 118*a-c* the edge of the canvas 200 is set in. The slope of the canvas 200 is also dependent on the height of the canvas support bar 122.

FIG. 8A shows the canvas support bar in an extended position 800, and the canvas 200 is almost vertical. FIG. 8B shows the canvas support bar in a retracted position 802, and the canvas 200 is more sloped. Thus, both the position of the canvas 200 in the selected ridge, and the height of the canvas support bar 122 determine the sloped position of the canvas 200.

For example, resting the edge of the canvas 200 in a proximal ridge 118*c* increases the slope of the canvas 200, while resting the edge of the canvas 200 in a distal ridge 118*a* positions the canvas 200 closer to the vertical. In some embodiments, the canvas 200 may include, without limitation, a drawing or painting board, an artist's canvas 200, a painting, and a generally flat panel.

Looking back at FIG. 2, the distal end 112*b* of the frame 102 includes a sleeve 120. The sleeve 120 is fixedly attached to the traversed support bar 110*a* at the distal end 112*b* of the frame 102. As described below, the sleeve 120 is configured to receive a canvas support bar 122. Looking again at FIG. 6, the canvas support bar 122 is insertable in the sleeve 120. The canvas support bar 122 is slidably moveable in the sleeve 120, so as to enable adjustable heights.

In one non-limiting embodiment, the canvas support bar 122 is a T-bar. An upper edge of the canvas 200 may rest on the canvas support bar 122 while a lower edge of the canvas 200 rests in a selected ridge 118*a-c*. This allows the canvas 200 to be selectively positioned at a desired angle relative to the artist.

Figure 5:
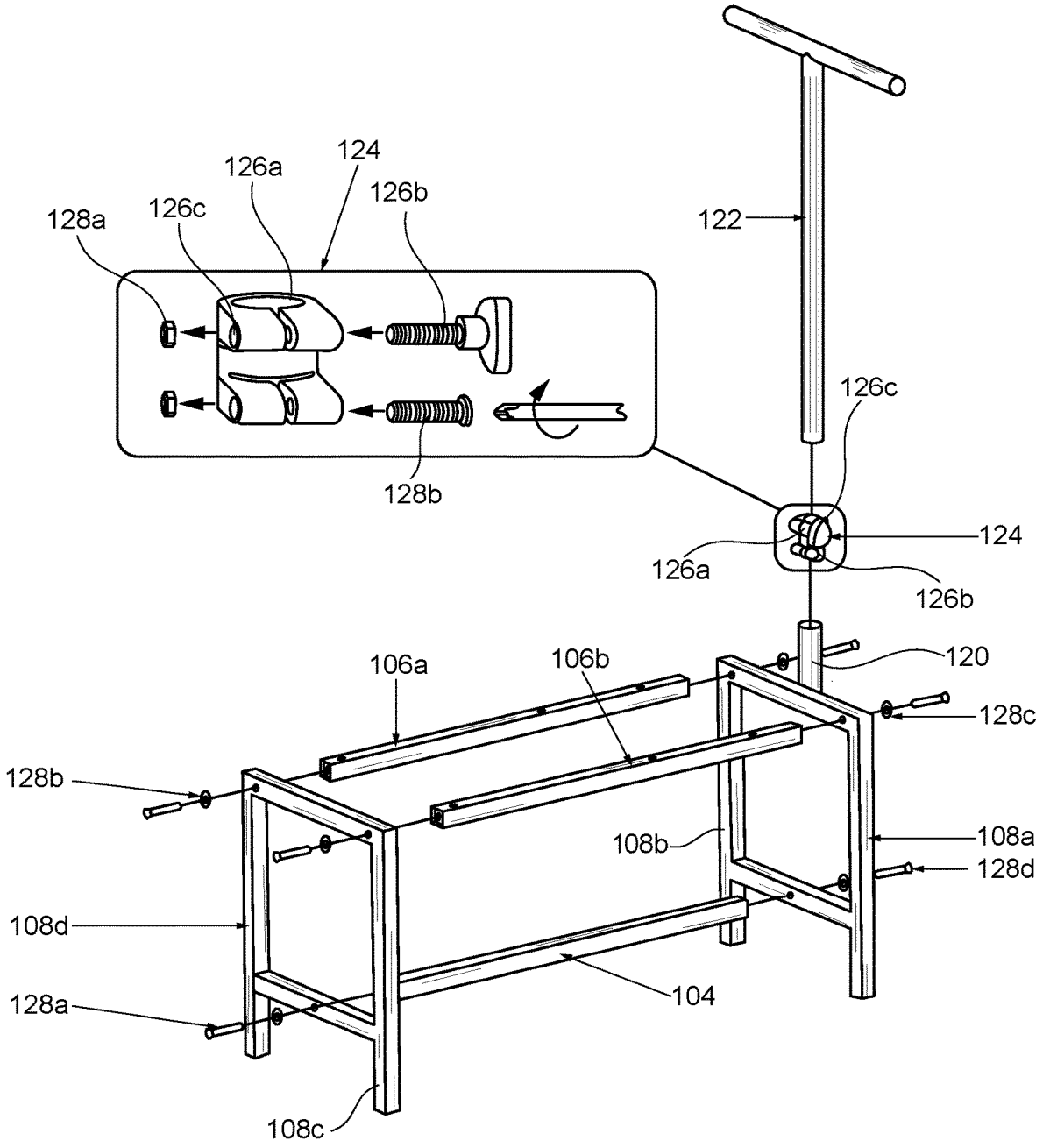
FIG. 5 illustrates a blow up view of the padded bench assembly shown in FIG. 4, showing a close up of the clamp, in accordance with an embodiment of the present invention.

As the close up illustration in FIG. 5 shows, the padded bench assembly 100 includes a clamp 124 that helps fasten the canvas support bar 122 against the sleeve 120. The clamp 124 comprises a body 126*a*, a friction mechanism 126*b*, and at least one fastening hole 126*c*. The body 126*a* of the clamp 124 surrounds the canvas support bar 122 and the sleeve 120 to restrict the canvas support bar 122 at a fixed position in the sleeve 120.

The friction mechanism 126*b* is rotatable in a first direction to at least partially tighten the body 126*a* of the clamp 124 about the canvas support bar 122 and the sleeve 120. Further, the friction mechanism 126*b* is rotatable in a second direction to at least partially loosen the body 126*a* of the clamp 124 from the canvas support bar 122 and the sleeve 120. In one non-limiting embodiment, the friction mechanism 126*b* comprises a threaded screw.

Figure 7:
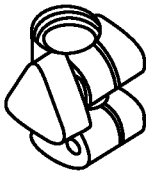
FIG. 7 illustrates perspective views of components of the padded bench assembly, including the clamp and various fasteners, in accordance with an embodiment of the present invention.
Figure 7:
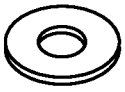
Figure 7:
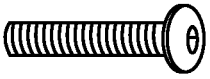
Figure 7:
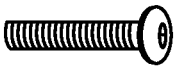
Figure 7:
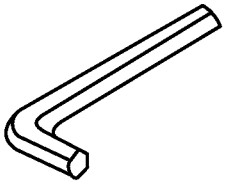
Figure 7:
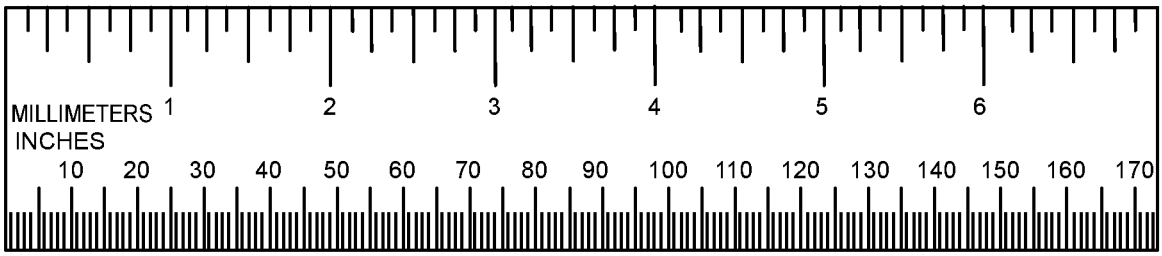

Turning now to the list of components referenced in FIG. 7, the padded bench assembly 100 utilizes at least one fastener 128*a-d* to restrict the canvas support bar 122 at a fixed position in the sleeve 120. Thus, both the fastener 128*a-d* and the above-mentioned clamp 124 work in conjunction to maintain the canvas 200 in a fixed position, and release the canvas support bar 122 to slide in and out of the sleeve 120 to a desired height.

The fastener 128*a*, 128*b*, 128*c*, 128*d* is configured to pass through the at least one fastening hole 126*c* of the clamp 124. In one embodiment, the fastener 128*a-d* and the fastening hole 126*c* are both threaded that allows for a rotatable relationship. Though in other embodiments, a friction fit relationship may be used.

In some embodiments, the fastener 128*a-d* may be rotatable in the first direction to at least partially tighten the body 126*a* of the clamp 124 about the canvas support bar 122 and the sleeve 120. The fastener 128*a-d* is also rotatable in the second direction to at least partially loosen the body 126*a* of the clamp 124 from the canvas support bar 122 and the sleeve 120.

In one non-limiting embodiment, the at least one fastener 128*a-d* comprises a washer 128*a* that creates spacing between the fastener 128*a* and the canvas support bar 122. In another embodiment, the at least one fastener 128*a-d* comprises a ¼"×1¾" Allen bolt 128*b*, and a ¼"×1⅜" Allen bolt 128*c*.

In some embodiments, the at least one fastener 128*a-d* is operable with an Allen wrench 204 to rotate the fastener 128*a-d*. In this manner, the position of the canvas support bar 122 is height adjustable relative to the sleeve 120 through manipulation of the friction mechanism 126*b* and the at least one fastener 128*a-d*. And thus, by adjusting the height of the canvas support bar 122, and the ridge on which the edge 804 of the canvas 200 rests, the slope of the canvas 200 can be set to a desired position.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A padded bench assembly with height adjustable easel and ridged surface, the assembly comprising:

a frame comprising at least one lower longitudinal support bar, at least one upper longitudinal support bar, four legs, and at least four traversed support bars extending between the legs, the frame defined by a proximal end and a distal end; wherein one of the traversed support bars located at the distal end of the frame and the upper longitudinal support bar comprise upper surfaces that define a plane a seat positioned longitudinally across the proximal end of the frame;

a canvas support panel positioned longitudinally across the distal end of the frame, the canvas support panel defined by a plurality of ridges; wherein the seat and the canvas support panel are supported in the plane by the frame a sleeve fixedly attached to the traversed support bar located at the distal end of the frame;

a canvas support bar insertable in the sleeve, the canvas support bar slidably moveable in the sleeve;

a clamp comprising a body, a friction mechanism, and at least one fastening hole, the body of the clamp surrounding the canvas support bar and the sleeve; and at least one fastener passing through the at least one fastening hole, the fastener being rotatable in the first direction to at least partially tighten the body of the clamp about the canvas support bar and the sleeve, the fastener being rotatable in the second direction to at least partially loosen the body of the clamp from the canvas support bar and the sleeve, whereby the canvas support bar is height adjustable relative to the sleeve through manipulation of the friction mechanism and the fastener.

2. The assembly of claim 1, wherein, the frame is elongated.

3. The assembly of claim 1, wherein, the frame is defined by a length of at least 29 inches.

4. The assembly of claim 1, wherein the canvas support bar comprises a horizontal member that forms a T-bar.

5. The assembly of claim 1, wherein the seat is cushioned.

6. The assembly of claim 1, wherein the friction mechanism is rotatable in a first direction to at least partially tighten the body of the clamp about the canvas support bar and the sleeve, the friction mechanism being rotatable in a second direction to at least partially loosen the body of the clamp from the canvas support bar and the sleeve.

7. The assembly of claim 1, wherein the fastener comprises a washer, the washer creating space between the fastener and the canvas support bar.

8. The assembly of claim 1, wherein the friction mechanism comprises a threaded screw.

9. The assembly of claim 1, further comprising an Allen wrench operable to enable rotation of the fastener.

10. The assembly of claim 9, wherein the at least one fastener comprises a ¼"×1¾" Allen bolt, and a ¼"×1⅜" Allen bolt.

11. The assembly of claim 1, wherein the ridges receive an edge of a canvas.

12. The assembly of claim 11, wherein the canvas comprises a drawing or painting board.

13. A padded bench assembly with height adjustable easel and ridged surface, the assembly comprising:

an elongated frame comprising at least one lower longitudinal support bar, at least one upper longitudinal support bar, four legs, and at least four traversed support bars extending between the legs, the frame defined by a proximal end and a distal end, the frame being defined by a length of at least 29 inches; wherein one of the traversed support bars located at the distal end of the frame and the upper longitudinal support bar comprise upper surfaces that define a plane a cushioned seat positioned longitudinally across the proximal end of the frame;

a canvas support panel positioned longitudinally across the distal end of the frame, the canvas support panel defined by a plurality of ridges, whereby the ridges receive an edge of a canvas; wherein the cushioned seat and the canvas support panel are supported in the plane by the frame a sleeve fixedly attached to the traversed support bar located at the distal end of the frame;

a canvas support bar insertable in the sleeve, the canvas support bar slidably moveable in the sleeve;

a clamp comprising a body, a friction mechanism, and at least one fastening hole, the body of the clamp surrounding the canvas support bar and the sleeve, the friction mechanism being rotatable in a first direction to at least partially tighten the body of the clamp about the canvas support bar and the sleeve, the friction mechanism being rotatable in a second direction to at least partially loosen the body of the clamp from the canvas support bar and the sleeve; and at least one fastener passing through the at least one fastening hole, the fastener being rotatable in the first direction to at least partially tighten the body of the clamp about the canvas support bar and the sleeve, the fastener being rotatable in the second direction to at least partially loosen the body of the clamp from the canvas support bar and the sleeve, whereby the canvas support bar is height adjustable relative to the sleeve through manipulation of the friction mechanism and the fastener.

14. The assembly of claim 13, wherein the fastener comprises a washer, the washer creating space between the fastener and the canvas support bar.

15. The assembly of claim 13, wherein the friction mechanism comprises a threaded screw.

16. The assembly of claim 13, further comprising an Allen wrench operable to enable rotation of the fastener.

17. The assembly of claim 16, wherein the at least one fastener comprises a ¼"×1¾" Allen bolt, and a ¼"×1⅜" Allen bolt.

18. The assembly of claim 13, wherein the ridges receive an edge of a canvas.

19. The assembly of claim 18, wherein the canvas comprises a drawing or painting board.

20. A padded bench assembly with height adjustable easel and ridged surface, the assembly consisting of:

an elongated frame comprising at least one lower longitudinal support bar, at least one upper longitudinal support bar, four legs, and at least four traversed support bars extending between the legs, the frame defined by a proximal end and a distal end, the frame being defined by a length of at least 29 inches; wherein one of the traversed support bars located at the distal end of the frame and the upper longitudinal support bar comprise upper surfaces that define a plane a cushioned seat positioned longitudinally across the proximal end of the frame;

a canvas support panel positioned longitudinally across the distal end of the frame, the canvas support panel defined by a plurality of ridges, whereby the ridges receive an edge of a canvas; wherein the seat and the canvas support panel are supported in the plane by the frame a sleeve fixedly attached to the traversed support bar located at the distal end of the frame;

a canvas support bar insertable in the sleeve, the canvas support bar slidably moveable in the sleeve;

a clamp comprising a body, a friction mechanism, and at least one fastening hole, the body of the clamp surrounding the canvas support bar and the sleeve, the friction mechanism being rotatable in a first direction to at least partially tighten the body of the clamp about the canvas support bar and the sleeve, the friction mechanism being rotatable in a second direction to at least partially loosen the body of the clamp from the canvas support bar and the sleeve;

at least one fastener passing through the at least one fastening hole, the fastener being rotatable in the first direction to at least partially tighten the body of the clamp about the canvas support bar and the sleeve, the fastener being rotatable in the second direction to at least partially loosen the body of the clamp from the canvas support bar and the sleeve, whereby the canvas support bar is height adjustable relative to the sleeve through manipulation of the friction mechanism and the fastener; and an Allen wrench operable to enable rotation of the fastener.

* * * * *